US006926051B2

(12) United States Patent
Engman

(10) Patent No.: US 6,926,051 B2
(45) Date of Patent: Aug. 9, 2005

(54) PLANING CUTTER

(76) Inventor: Anders Engman, Hallonvagen 14, S-641, 47 Katrineholm (SE)

( * ) Notice: Subject to any disclaimer, the term of this patent is extended or adjusted under 35 U.S.C. 154(b) by 217 days.

(21) Appl. No.: 10/362,124

(22) PCT Filed: Aug. 20, 2001

(86) PCT No.: PCT/SE01/01775

§ 371 (c)(1),
(2), (4) Date: Feb. 21, 2003

(87) PCT Pub. No.: WO02/16095

PCT Pub. Date: Feb. 28, 2002

(65) Prior Publication Data

US 2004/0035497 A1 Feb. 26, 2004

(30) Foreign Application Priority Data

Aug. 21, 2000 (SE) ..... 0002961

(51) Int. Cl.[7] ..... B27C 1/00; B27C 5/00

(52) U.S. Cl. ..... 144/173; 144/174; 144/218; 144/230; 144/117.1

(58) Field of Search ..... 144/162.1, 172–174, 144/218, 220, 230, 240, 114.1, 117.1

(56) References Cited

U.S. PATENT DOCUMENTS 1,810,823 A * 6/1931 Freas et al. ..... 83/836
4,343,215 A * 8/1982 Fuchs ..... 83/698.41
4,400,117 A * 8/1983 Smith ..... 407/49
5,571,250 A * 11/1996 Stegmaier ..... 144/218
6,202,721 B1 * 3/2001 Stegmaier ..... 144/230

FOREIGN PATENT DOCUMENTS

| | | |
|---|---|---|
| DE | 198 18 626 | 10/1999 |
| FR | 2 703 610 | 10/1994 |
| NL | 94 15111 | 1/1995 |

* cited by examiner

*Primary Examiner*—Allen Ostrager
*Assistant Examiner*—Shelley Self
(74) *Attorney, Agent, or Firm*—Dykema Gossett PLLC

(57) ABSTRACT

The invention is a planing cutter with a cylindrical cutter body (1) with recesses (3) along its enveloping surface. Each recess is delimited by a front wall (4), a rear wall (5) and a bottom (6) and contains a cutting element (7). Each cutting element (7) has a cutting edge (8), a lower edge (9), two lateral edges (10,11), a front face (12) and a rear face (13). One clamping device (2) is also located in each recess.

According to the invention each lateral edge (10,11) of the cutting element (7) has a range (14) of grooves. At least one groove in each range interacts with a peg (17,18) protruding from one of the walls (4,5) of the recess (3). The invention also concerns a cutting element (7) for use with the cutter of the invention.

6 Claims, 1 Drawing Sheet

PLANING CUTTER

The present invention refers to a planning cutter for planning wood, and in particular to a cutting element.

In a planing machine of the kind using this kind of cutter, there are usually several cutter units, normally six, arranged for simultaneous planing of the upper, lower and lateral faces of a board.

A planing cutter should preferably have a relatively large number of seats with cutting elements. A large number of cutting elements allows larger cutting capacity, better surface smoothness of the planed faces and lower noise level. On a cutter with 160 mm diameter there are normally seats for six cutting elements. Clamping and locking of the elements is an important aspect here. Of course, it must be safe, it must be simple and it should have small peripheral dimension. The number of cutting elements to be applied to a planing cutter is normally limited by the peripheral space needed for the clamping mechanism.

It is especially desirable to allow high rotational velocity of the cutter, if possible to reach velocities around 10–12 000 rpm. At such velocities the stability and safety of the clamping has a decisive importance. When centrifugal forces are as great as in this velocity region, there is a tendency for the cutting elements of the cutter to move radially outward. The clamping must be such that this is prevented or at least reduced to an acceptable level even at such high velocities. The clamping position of the cutting elements should also be radially adjustable to allow regrinding of the edges.

Conventionally, each cutting element is located in a recessed seat in the cutter and clamped against one of the walls of the recess. Such a clamping constitutes a force defined connection, where the defining force is a frictional force. To make the clamping safer, it is previously known to supplement it with a shape defined connection.

Examples of such clamping of the cutting elements to the body of a cutter are described in EP 455 196, WO 94/07665, DE 3701053 and CA 2135146.

EP 455 196 shows in FIG. 1 how a cutting element is clamped to a recess in the body of the cutter by a clamping wedge. The cutting element is further locked by a peg located in one wall of the recess and penetrating through a hole in the element. The cutting element is then not adjustable in the radial direction. Furthermore, this type of clamping has the disadvantage of requiring providing of a hole through the cutting element, which reduces its strength and increases its cost of manufacture.

WO 94/07665 describes a clamping device with a positioning device for the cutting element. One wall of the recess is furthermore provided with serrations matching serrations on one wall of the cutting element. The cutting element can be radially relocated and placed in a new operative position where the serrations match again. Since this device requires that the wall of the recess as well as one side of the element are provided with serrations, it will be complicated and costly from a manufacturing viewpoint.

DE 3701053 describes a device which in principle corresponds to the above, and also suffers from the same disadvantages.

CA 2135146 describes a device where the cutting element is clamped by a tensioning element. Furthermore, one side of the cutting element is provided with a groove interacting with a groove in a support plate rigidly attached to the cutter body. The interaction is by means of a locking element protruding into the grooves of the cutting element as well as the support plate. This locks the cutter element to the recess by a shape connection. The support plate has a number of grooves to let the locking element interact with an arbitrary groove of the support plate. In this way the radial position of the cutting element can be adjusted. This device must also be regarded as complicated to manufacture, since the cutting element must be provided with a groove, and the support plat with a number of grooves.

In relation to this background, the purpose of the present invention is to provide a planing cutter which in a simpler way than previously known will allow a stable and safe clamping of the cutting element, even at high rotational velocities, and which will permit adjustment of the radial position of the cutting element. According to the invention, this purpose is achieved when a planing cutter of the kind described in the introductory part of claim 1 is provided with the special features described in the characterizing part of the claim.

Due to interaction between a groove in the cutting element and a peg projecting from the wall of the recess, a safe shape defined locking of the cutting element is achieved, capable of resisting high rotational velocities without noticeable outward displacement of the cutting element. Since the cutting element has a range of grooves at each lateral edge, the radial adjustment is easily achieved. Such grooves at the lateral edges of the cutting element can be easily provided by profile grinding. Provision of pegs at the wall of the recess is also easily achieved. According to the present invention stable clamping and radial adjustability can be combined in a simpler and less costly way than in prior art.

The characterizing feature of claim 1 that the peg or pegs protrude from the wall of the recess means that they may protrude directly from the wall. It should also be interpreted so that the pegs can protrude from a separate element rigidly connected to the wall, such as a plate adjoining and attached to the wall by screws.

According to one preferred embodiment of the invention, two grooves within each range of grooves each interact with a peg protruding from the wall of the recess. The provision of two pegs on each side provides improved stability and safety of the clamping.

According to another preferred embodiment of the invention, the number of grooves interacting with pegs is less than the total number of grooves in the range. This is an efficient and simple way to facilitate radial adjustment of the cutting element.

According to another preferred embodiment each peg has a circular cross-section. This allows a simple mechanical design, optimal strength and simple removal from the wall.

According to another preferred embodiment each groove has a circular arc profile. This ensures good contact between groove and peg, to spread the force over a larger surface.

According to another preferred embodiment each peg is fastened to the wall by having its end portion inserted in a drilled hole in the wall. This makes attachment of the peg to the wall very simple.

According to another preferred embodiment the clamping device comprises a clamping element in contact with one face of the cutting element and covering both ranges of grooves. With such a clamping element the risk of loosening of the pegs is eliminated.

The preferred embodiments mentioned above are described in the claims dependent on claim 1.

The purpose stated can according to a second aspect of the invention be achieved with a cutting element with the features of the characterizing part of claim 1. Such a cutting element is suitable for use in a planing cutter according to the invention, and will provide advantages corresponding to what was mentioned above.

The invention will be further explained by the following detail description of a preferred embodiment of it with reference to the accompanying figures.

Figure 1:
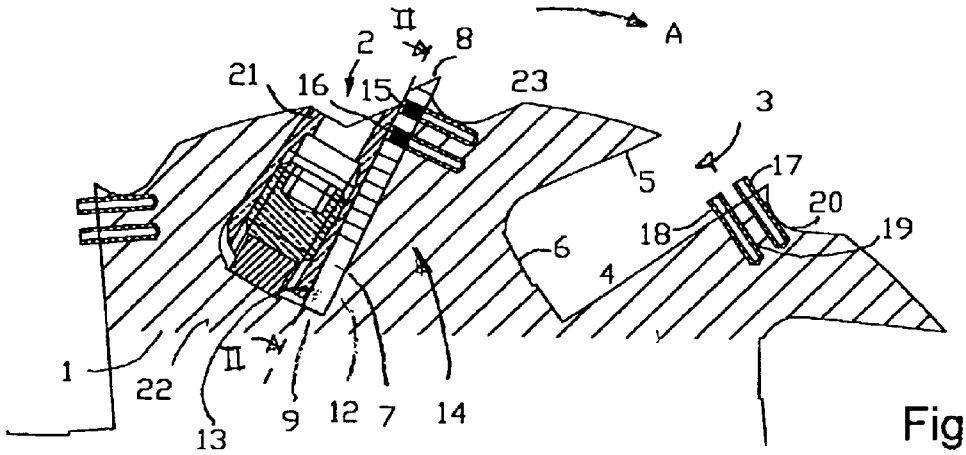
FIG. 1 shows a radial section through a part of a planing cutter according to the invention.

In FIG. 1 is shown a radial section of a planing cutter according to the invention. The cutter comprises a cutter body 1 arranged to rotate in the direction of arrow A when planing. In the enveloping surface of the body 1 is located a number of recesses 3, in the example shown twelve such recesses. In each recess is located one cutting element 7 and one clamping device 2. In front of each cutting element there is a chip-breaker 23 made as a arcuate ditch. The clamping device 2 comprises a wedge-shaped body 21 and a clamping screw 22. Their function will be further described below in connection with FIG. 3. The wedge-shaped body keeps the cutting element 7 pressed against the front wall 4 of the recess, locking the element between the wedge-shape body 21 and the wall 4.

The cutting element is laterally limited by two lateral edges, and in each of those a range of grooves 14 is provided. In the front wall 4 of the recess 3 are provided holes 19,20, and in each of those a peg 17,18 is located, protruding from the wall 4. Each peg 17,18 interacts with one groove each 15,16 in the range of grooves.

Figure 2:
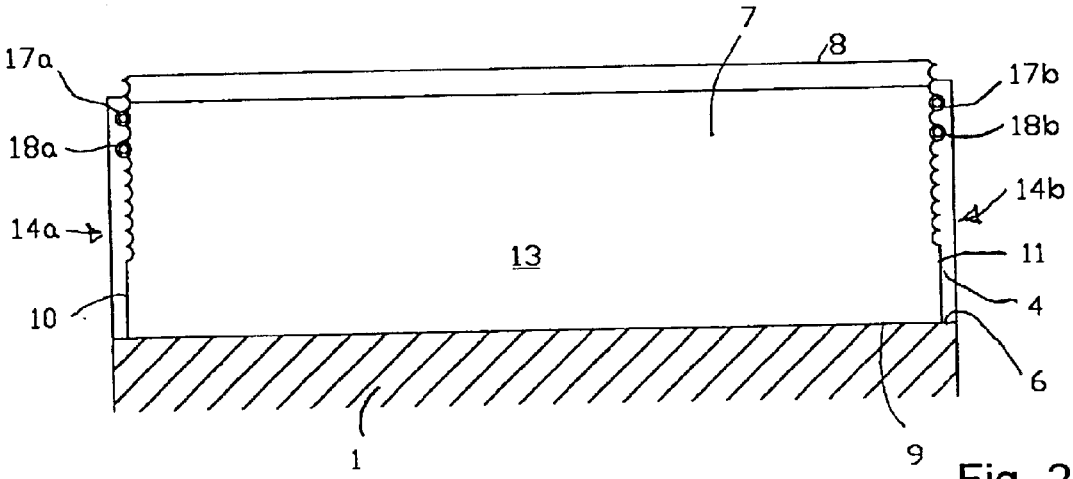
FIG. 2 is an axial section along the line II—II of FIG. 1.

FIG. 2 which is a section along the line II—II in FIG. 1 further explains the shape of the cutting element 7. The figure shows the rear face 13 of the cutting element 7, the face oriented to the rear relative to the direction of rotation. At the upper part of the figure is the cutting edge 8 and in the bottom part the lower edge 9. This figure clearly shows how each lateral edge 10,11 of the cutting element is provided with a range of grooves 14*a*, 14*b*. In the example shown there are twelve such grooves located at each lateral edge, each with a semicircular profile. The number of grooves may of course be different, and the profile may be otherwise. The profile may be V-shaped for instance.

In FIG. 2 is also indicated the front wall 4 of the recess in the cutter body. As shown the recess is somewhat broader than the length of the cutting element 7, to let an outer part of the front wall 4 extend a few mm past each lateral edge 10,11. From the wall 4 the two pegs 17*a*, 18*a*, 17*b*, 18*b* extend at each lateral edge at right angle to the plane of the figure. The pegs are shown as cylindrical tubes. By these pegs 17*a*, 18*a*, 17*b*, 18*b* interacting with the corresponding grooves the cutting element is locked without possibility to move.

The cutting element 7 is,shown in FIGS. 1 and 2 as new, without having been re-sharpened, and its lower edge is then close to the bottom of the recess. One common size of a cutting element as in the example shown is 106×35 mm. The grooves in the range of grooves 14*a*, 14*b* may have a radius of 1 mm. The pegs 17*a*, 18*a*, 17*b*, 18*b* may then have a diameter of 2 mm and a total length of 10,3 mm. The centre distance between adjacent pegs 17*a*, 18*a* on one side may be 4 mm.

Figure 3:
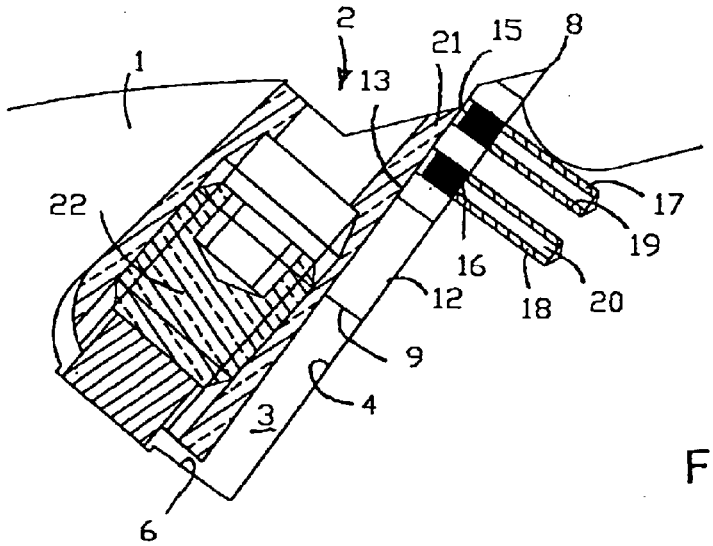
FIG. 3 is an enlarged section corresponding to FIG. 1 and shows the cutting element in a second position.

In FIG. 3 which is similar to FIG. 1 but in enlarged scale the cutting element is shown in its radially outermost position, where the inner peg 18 interacts with the innermost groove. This figure shows that a clamping element 21 covers the openings of the grooves at the rear face 13 of the cutting element. The clamping element 21 has a width corresponding to the breadth of the recess. The clamping element 21 is wedge-shaped and the recess 3 also has a corresponding wedge shape section. The clamping element is loosened or tightened with one or more clamping screws 22. By screwing them inward the clamping element 21 is pressed upward to contact against the rear wall 5 of the recess 3 and against the rear side 13 of the cutting element 7, thereby locking the cutting element 7 between the clamping element 21 and the front wall 4 of the recess.

When a new cutting element as shown in FIGS. 1 and 2 becomes worn and blunt, the cutting element is released by loosening the clamping screws 22. The clamping element 21 can the be moved down into the recess where it becomes loose and can be pulled out axially from the cutter. The cutting element 7 can then be removed from the position shown in FIG. 1 to be re-sharpened. The cutting element is then ground off an amount corresponding to the centre distance between two grooves. The cutting element is then replaced between the pegs, but now radially displaced so far that each peg interacts with a groove located radially nearest below the groove it formerly interacted with. After replacing and re-tensioning of the clamping element 21, the cutter is again ready for planing. Re-sharpening and adjusting can be made several times until finally the innermost of the grooves is used for interaction with a peg as shown in FIG. 3.

It should be obvious that all dimensions mentioned above are only to be interpreted as examples.

What is claimed is:

1. A planing cutter comprising: a cylindrical cutter body having an outer surface formed with a plurality of recesses therein, said recesses delimited by a front wall, a rear wall and a bottom, each recess containing a cutting element with a cutting edge having two axial ends, a lower edge, two lateral edges, a front face and a rear side, said recess also containing a clamping device, each lateral edge of the cutting element having a range of grooves, and at least one groove in each range interacting with a peg projecting from one wall of the recess, and by the number of grooves in each range engaging a peg being less than the total number of grooves in the range the axial length of the cutting edge being smaller than the axial width of the cutter body, each lateral edge extending from the corresponding end of the cutting edge along a line perpendicular to the cutting edge.

2. The planing cutter according to claim 1, wherein two of the grooves in each range engage with each one peg projecting from the wall.

3. The planing cutter according to claim 1, wherein each peg has a circular section.

4. The planing cutter according to claim 1, wherein each groove has a circular arc section.

5. The planing cutter according to claim 1, wherein each peg is attached to the wall by having one end portion inserted in a hole drilled in the wall.

6. The planing cutter according to claim 1, wherein the clamping device comprises an element in contact with one face of the cutting element and covering both ranges of grooves.

* * * * *